US005666879A

United States Patent [19]

Kutscher et al.

[11] Patent Number: 5,666,879

[45] Date of Patent: Sep. 16, 1997

[54] STAMPLING MACHINE OR PRESS, PARTICULARLY MINTAGE OR COINING PRESS

[75] Inventors: Hans-Werner Kutscher, Braunschweig; Heinz Groos, Netphen; Christain Schultens, Niederfischbach, all of Germany

[73] Assignee: Gräbener Pressensysteme GmbH & Co. KG, Netphen, Germany

[21] Appl. No.: 418,535

[22] Filed: Apr. 7, 1995

[30] Foreign Application Priority Data

Apr. 7, 1994 [DE] Germany ..... 44 11 900.3

[51] Int. Cl.[6] ..... B44B 5/00

[52] U.S. Cl. ..... 101/3.1; 101/4

[58] Field of Search ..... 101/3.1, 4, 20, 101/18, 35; 74/569, 53, 54

[56] References Cited

U.S. PATENT DOCUMENTS

| | | | |
|---|---|---|---|
| 1,863,199 | 9/1930 | Fowler et al. . | |
| 2,792,779 | 5/1957 | Toeppen et al. | 101/3.1 |
| 3,946,663 | 3/1976 | Engeriser | 101/3.1 |
| 4,138,904 | 2/1979 | Osuka et al. | 74/570 |
| 4,276,823 | 7/1981 | Rotzler | 100/257 |
| 4,318,325 | 3/1982 | Bareis et al. | 83/530 |
| 4,376,744 | 3/1983 | Desantis | 264/106 |
| 4,410,287 | 10/1983 | Speicher | 101/4 |
| 4,434,646 | 3/1984 | Maeda et al. | 72/451 |
| 4,852,382 | 8/1989 | Gietz et al. | 72/406 |
| 4,934,173 | 6/1990 | Bakermans et al. | 72/451 |
| 4,958,559 | 9/1990 | Bubley et al. | 101/123 |
| 5,070,800 | 12/1991 | Iwata | 74/569 |
| 5,176,075 | 1/1993 | Vegue | 100/282 |
| 5,404,806 | 4/1995 | Proctor | 101/118 |

FOREIGN PATENT DOCUMENTS

| | | | |
|---|---|---|---|
| 0047030 | 3/1982 | European Pat. Off. | 101/4 |
| 0151204 | 8/1985 | European Pat. Off. . | |
| 320958 | 2/1984 | Germany | 101/3.1 |
| 0151204 | 8/1985 | Germany . | |
| 0222787 | 10/1986 | Japan | 101/3.1 |
| 1433112 | 4/1976 | United Kingdom . | |
| 9101214 | 2/1991 | WIPO . | |

*Primary Examiner*—Edgar S. Burr
*Assistant Examiner*—Anthony H. Nguyen
*Attorney, Agent, or Firm*—Friedrich Kueffner

[57] ABSTRACT

A stamping press, stamping machine, or the like, particularly a mintage or coining press, includes a driven connecting rod which is connected through toggle levers to a coining slide. The connecting rod is in contact with a cam plate mounted on a drive shaft through sliding supports arranged on opposite sides of the drive shaft, wherein the cam plate preferably has two different circumferential cam shapes which supplement each other.

4 Claims, 2 Drawing Sheets

STAMPLING MACHINE OR PRESS, PARTICULARLY MINTAGE OR COINING PRESS

BACKGROUND OF THE INVENTION

1. Field of the Invention

The present invention relates to a stamping press, stamping machine, or the like, particularly a mintage or coining press. The press includes a driven connecting rod which is connected through toggle levers to a coining slide.

2. Description of the Related Art

A mintage or coining press of this type has become known from EP 0 151 204 A1. The press includes a coining slide drive which is composed of a triangular lever driven through a center bearing by a crankshaft, wherein the triangular lever is connected with a rear link bracket to a rod and is connected through the rod on a frame with a front link bracket through a pressure rod to the coining slide. The drive of the slide generates through a reversing drive a drive of an ejector coining die for producing an ejection movement which takes place essentially simultaneously with the movement of the slide from the front dead center to the rear dead center thereof.

In order to make available sufficient space and time for transporting or further transporting the blanks or finished coins which are usually supplied in such mintage or coining presses by a rotary table, the known press operates with an appropriately modified lever construction. Aside from the fact that such a lever construction does not allow a general purpose use, it is additionally not possible to achieve defined positions of rest; rather, the connecting rod which actuates the slide through the toggle levers and is driven by a driven crankshaft, carries out an oscillating movement. This oscillating movement may lead to overswinging and to an unsteady machine operation.

SUMMARY OF THE INVENTION

Therefore, it is the primary object of the present invention to provide a press, particularly a mintage or coining press, of the above-described type in which the press stroke can be influenced in a simple manner and without the above-described disadvantages in such a way that sufficient space and time is provided for supplying and removing the workpieces.

In accordance with the present invention, the connecting rod is in contact with a cam plate mounted on a drive shaft through sliding supports arranged on opposite sides of the drive shaft, wherein the cam plate preferably has two different circumferential cam shapes which supplement each other.

As a result of the configuration according to the present invention, a different circumferential cam shape of the cam plate is assigned to each of the sliding supports which are arranged at a constant distance from each other, wherein the different circumferential cam shapes supplement each other in such a way that two curves are produced which pass each other by, i.e., a work curve and a complementary curve. The two different circumferential cam shapes may also be obtained by providing two separate cam plates next to each other.

The present invention provides a novel drive without crankshaft which permits any chosen variation of the sequence of movements, so that, even in high-speed presses or stamping machines with small strokes of, for example, 6 mm, periods of rest or stillstands can be adjusted for making it possible without problems to supply blanks for, for example, coins, metals, shims, etc., and to remove the finished products produced from the blanks.

Contrary to the geometrically determined lever system of the known press, by exchanging the cam plate or cam plates and the sliding supports, it is possible to achieve any desired sequence of movement and, for example, also two strokes during one rotation of the drive shaft; in the latter case, lower rates of rotation are possible. The resulting curve of the sequence of movement becomes increasingly more egg-shaped or oval with increasing stroke, wherein the curve of the sequence of movement is superimposed on the cam plate having two different cam shapes by the movement of the drive shaft as a result of the support of the connecting rod through the sliding supports.

In accordance with a preferred embodiment of the present invention, the sliding supports are sliding blocks or sliding shoes. Of course, the pairing of materials selected for the sliding blocks and the cam plate or plates must make an operation with low wear possible; nevertheless, the sliding blocks projecting into the hub of the connecting rod can be easily mounted and, thus, easily exchanged.

The sliding blocks which rest against the cam plate or plates with concave, large sliding surfaces produce a favorable surface pressure. Alternatively, when smaller forces occur, rollers could be used which produce better frictional conditions, however, which would be subject to higher surface pressures and would have to rotate with higher speeds.

In accordance with a preferred feature of the invention, the sliding supports are arranged offset relative to each other in axial direction of the drive shaft. Consequently, the sliding blocks or rollers supporting the cam plate or plates in adjacent planes ensure that the complementary curves of movement produced by the drive pass each other by.

In accordance with a further development of the invention, the connecting rod and the housing of the press form parallelogram-type levers. The parallelogram-type levers are formed by a connecting plate of the connecting rod which is connected to or rests on the press housing. On the one hand, the parallelogram-type levers absorb the transverse forces occurring during the press operation. On the other hand, the parallelogram-type levers hold the connecting rod in an exact position, so that the desired curves of movement can be exactly obtained.

In accordance with a recommended feature, the toggle lever system includes two pressure pieces which are coupled to each other in an articulated manner. The resulting large-surface, connecting plate-like pressure pieces make it possible to transmit high forces to the coining slide.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
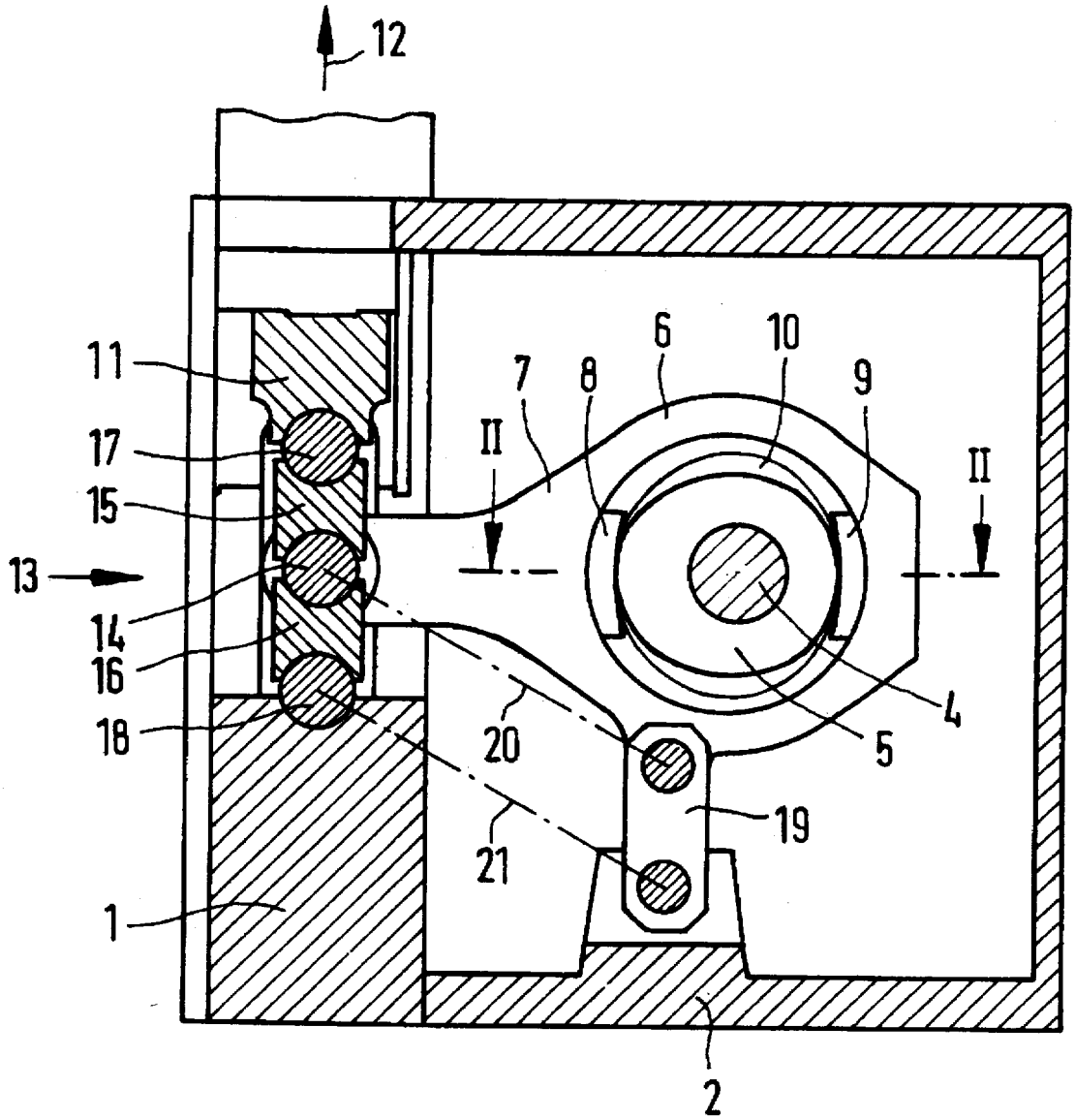
FIG. 1 is a partially sectional schematic view of a mintage press or a stamping machine according to the present invention.

FIG. 1 of the drawing merely shows a portion of the press frame 1 and the press housing 2 of a press according to the present invention, which may be of vertical construction or horizontal construction. A cam plate 5 with two different circumferential cam shapes is mounted on a drive shaft 4. The drive shaft 4 is driven by a motor, not shown, and is supported in the press housing 2 in bearings 3, as shown in FIG. 2.

The hub 6 of a connecting rod 7 is indirectly supported on the cam plate 5. Thus, the connecting rod 7 rests against the cam plate 5 with sliding supports 8 and 9 which are provided with concavely shaped support surfaces and which are arranged offset relative to each other in axial direction of the drive shaft, as shown in FIG. 2. The sliding supports 8 and 9 are releasably mounted on diametrically opposite sides in the connecting rod 7 so as to project from the bore of the hub 6 of the connecting rod 7. The portion of the cam plate 5 assigned to the sliding support 8 has a different cam shape than the portion of the cam plate 5 assigned to the sliding support 9.

Figure 2:
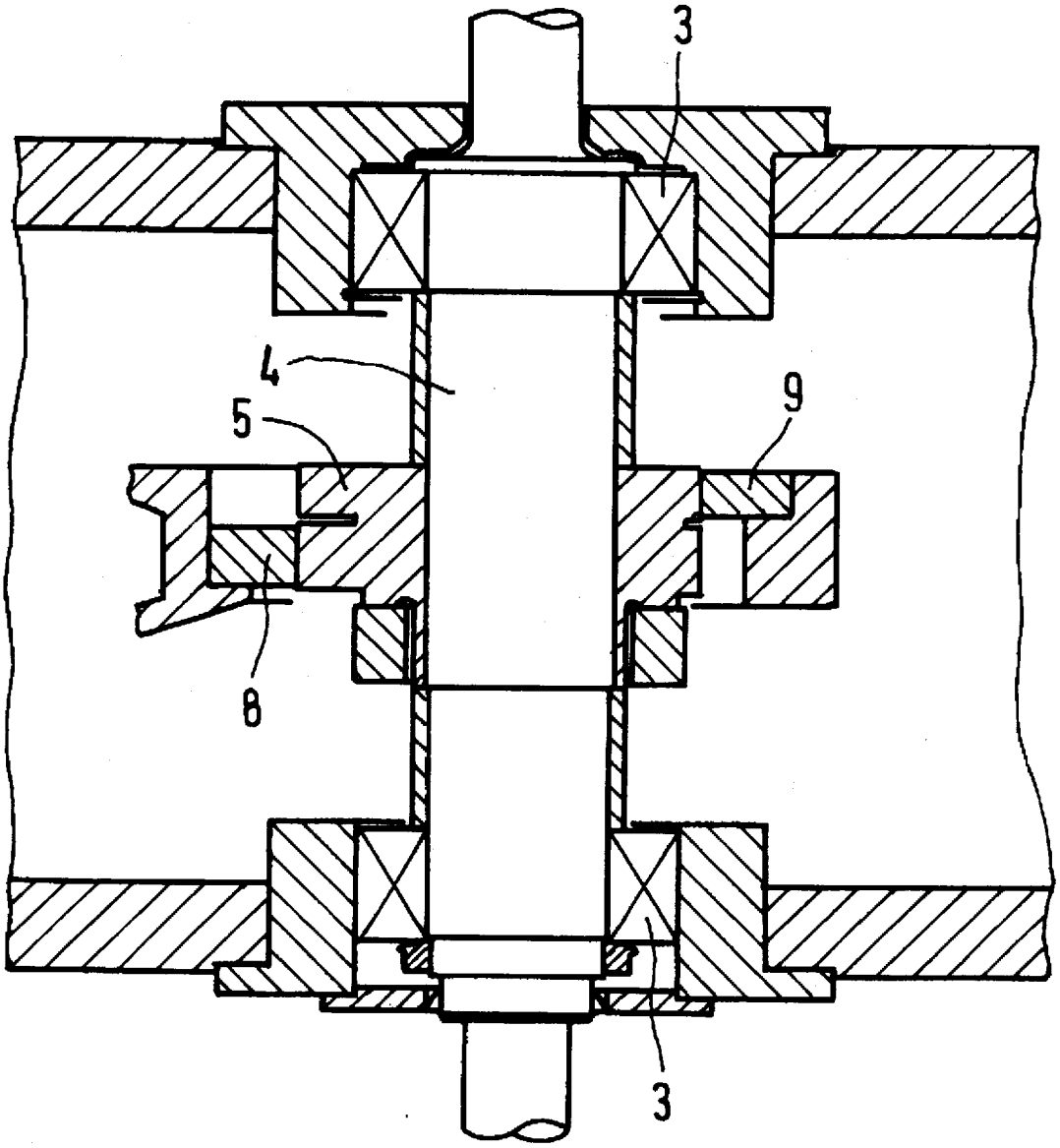
FIG. 2 is a sectional view, on a larger scale, taken along sectional line II—II of FIG. 1.

Arrangements of the sliding supports 8, 9 different from the offset arrangement shown in FIG. 2 are possible. The offset arrangement causes a relative passing by of the complementary curves or the work curve and the complementary curve resulting from the rotation of the drive shaft 4 and the contact of the sliding supports 8, 9 with the two different circumferential cam shapes of the cam plate 5.

FIG. 1 shows the curve shape 10 during the coining slide stroke caused by the support of the cam plate 5 against the sliding supports 8, 9. The shape 10 becomes more oval as the stroke or the travel distance imparted to the coining slide 11 by the connecting rod 7 increase. The sequence of movement can be varied in any chosen manner by exchanging the cam plate 5 and the sliding supports 8, 9. However, the sequence of movements is always configured in such a way that sufficient space and a standstill of the stroke can be achieved. During this period, a new blank for pressing or stamping can be introduced into the processing position and a finished pressed or stamped piece can be unimpededly removed or ejected.

A toggle lever system 13 connects the connecting rod 7 to the coining slide 11 which is used to move the pressing or stamping die in the direction of arrow 12 shown in FIG. 1. The toggle lever system 13 includes two pressure pieces 15 and 16 which are connected to each other through a toggle lever bolt 14. The pressure pieces 15 and 16, in turn, are connected in an articulated manner through a toggle lever bolt 17 and 18, respectively, to the coining slide 11 or the press frame 1. The pressure pieces 15, 16 of the toggle lever system 17 have large surfaces and make it possible to transmit high forces to the coining slide 11.

The connecting rod 7 which is driven without a crankshaft is provided with a connecting plate 17 which is supported in the press housing 2 and, together with the press housing 2, forms parallelogram levers which are schematically illustrated in dash-dot lines in FIG. 1. The parallelogram levers 20, 21 absorb the occurring transverse forces, on the one hand, and, on the other hand, the parallelogram levers 20, 21 hold the connecting rod 7 in an exact position according to which the shape of the curve 10 for the stroke movement can be configured.

The invention is not limited by the embodiments described above which are presented as examples only but can be modified in various ways within the scope of protection defined by the appended patent claims.

We claim:

1. A coining or stamping press comprising a drive shaft, a cam plate mounted on the drive shaft, a coining slide member and a connecting rod, a toggle lever connecting the coining slide member and the connecting rod, sliding supports being mounted on the connecting rod on opposite sides of the cam plate, wherein the cam plate has two different cam surfaces in contact with the sliding supports, wherein the two cam surfaces define two curves which pass each other for forming a crankshaft-free drive of the coining slide member, further comprising a press housing and levers connecting the connecting rod and the press housing.

2. The press according to claim 1, wherein the sliding supports are sliding blocks.

3. The press according to claim 1, wherein the sliding supports are arranged offset relative to each other in axial direction of the drive shaft.

4. The press according to claim 1, wherein the toggle lever comprises two pressure pieces coupled to each other in an articulated manner.

* * * * *